US006753511B2

(12) United States Patent
Mathews, Jr. et al.

(10) Patent No.: US 6,753,511 B2
(45) Date of Patent: Jun. 22, 2004

(54) SYSTEM AND METHOD FOR THERMAL LIMITING OF THE TEMPERATURE OF A COOKTOP WITHOUT USING A TEMPERATURE SENSOR

(75) Inventors: Harry Kirk Mathews, Jr., Clifton Park, NY (US); Joseph Lucian Smolenski, Slingerlands, NY (US); John Stanley Glaser, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 96 days.

(21) Appl. No.: 10/255,361

(22) Filed: Sep. 26, 2002

(65) Prior Publication Data

US 2004/0060923 A1 Apr. 1, 2004

(51) Int. Cl.[7] ..... H05B 1/02
(52) U.S. Cl. ..... 219/492; 219/510
(58) Field of Search ..... 219/482, 483, 219/485, 486, 490, 491, 492, 497, 507, 509, 510; 361/93.8, 93.9, 103, 104

(56) References Cited

U.S. PATENT DOCUMENTS 3,783,366 A * 1/1974 Cox ..... 363/3
4,496,829 A * 1/1985 Black et al. ..... 219/497
4,777,350 A * 10/1988 Crocket et al. ..... 219/497
5,708,256 A * 1/1998 Montagnino et al. ..... 219/497
6,108,183 A * 8/2000 Beene ..... 361/93.8
6,150,641 A 11/2000 Wilkins
6,285,012 B1 9/2001 Connolly et al.
6,417,496 B1 * 7/2002 Bates et al. ..... 219/448.11
6,577,109 B2 * 6/2003 Dancy et al. ..... 323/272

* cited by examiner

*Primary Examiner*—Sang Y. Paik
(74) *Attorney, Agent, or Firm*—Scully, Scott, Murphy & Presser

(57) ABSTRACT

A system and method for limiting the temperature of a burner for a cooking appliance without the use of a temperature sensor. The method includes the step of sensing the conduction state of a thermal switch and feeding back the sensed signal to control the duty-cycle (and thus "on" time) of bang-bang thermal limiting control. The power to the burner is reduced until the sensed duty-cycle (near 100%) cycling is reduced (lower frequency and amplitude) resulting in smoother power and temperature control. Preferably, the control system and method is implemented for controlling power applied to a burner for a glass-ceramic cooktop.

28 Claims, 9 Drawing Sheets

SYSTEM AND METHOD FOR THERMAL LIMITING OF THE TEMPERATURE OF A COOKTOP WITHOUT USING A TEMPERATURE SENSOR

BACKGROUND OF THE INVENTION

1. Field of the Invention

The present invention relates to temperature control systems for cookware and, particularly, to a novel thermal limiting system and method for controlling application of thermal energy to a burner element of a cookware apparatus.

2. Discussion of the Prior Art

The life of the glass ceramic material forming a cooking surface or burner in a cookware apparatus is dependent on the temperature it is subjected to. Therefore, the power to a burner must be limited to prevent premature failure of the glass. The temperature of the glass is a function of time, burner power and the properties of the cooking utensil place on it (e.g. flatness, reflectivity, contents, etc.) consequently a method of dynamically adjusting the power to prevent overheating is needed, i.e. thermal limiting control.

In conventional systems, the temperature is limited in two ways: 1) by using of a temperature switch that interrupts power to the burner at excessive temperatures such as described in U.S. Pat. No. 6,150,641, the whole contents and disclosure of which is incorporated by reference as if fully set forth herein; or, 2) by directly sensing the temperature and applying appropriate feedback control such as described in U.S. Pat. No. 6,285,012, the whole contents and disclosure of which is incorporated by reference as if fully set forth herein.

The first thermal limiting approach 10, as described in U.S. Pat. No. 6,150,641, and illustrated in FIG. 1(*a*), includes implementing a thermal switch and bang-bang thermal limiting to control the temperature 18 of the cookware burner 12, and incorporates a power control component 14 receiving the power command signal 16 which, in this approach, constitutes the user power command signal. This approach is inexpensive but results in large swings in power and temperature of the cooking utensil. That is, in this first approach, a thermal switch is used to provide bang-bang temperature control when the temperature exceeds the predetermined limit. This type of control results in the frequent cycling of the power causing corresponding swings in the pan temperature.

FIG. 2(*a*) illustrates an example simulation of bang-bang thermal control implemented for a ceramic burner. In the example simulation, the thermal switch is modeled as a relay with an arbitrary 30° C. of hysteresis, and the thermal response of the burner (e.g., glass temperature output) is modeled as a first order linear model (derived empirically). Initially, as shown in FIG. 2(*a*), the user-demanded power setting (user power command signal) is about one-half (50%)of the maximum power. At this initial setting, thermal limiting does not engage as indicated in FIG. 2(*b*). At the time indicated at 141, the user increases the power to 100% (FIG. 2(*a*)) causing the conduction state 145 of the thermal switch (e.g., bi-metallic switch) to change in accordance with bang-bang thermal limiting at time indicated as time 142. In FIG. 2(*b*), the conduction on/off states, i.e., engagement of bang-bang thermal limiting, is represented as the plot 145. At this setting, the glass temperature of the burner increases to the thermal limit 182, e.g., the safety thermal limit of a glass burner, as shown in FIG. 2(*c*). Finally, the user reduces the power back to its initial one-half power level and thermal limiting ceases, as indicated at time 143 in FIG. 2(*a*).

The second thermal limiting approach 20, as described in U.S. Pat. No. 6,285,012, and illustrated in FIG. 1(*b*), includes implementing a thermal limiting controller component 22 that limits thermal heating of burner 12' in accordance with the user power command signal 16', a predetermined thermal limit signal 25, and an instantaneous sensed temperature 28 that is feedback from a temperature sensor element included with the burner 12'. As described in U.S. Pat. No. 6,285,012, the controller includes proportional plus integral control, minimum selector and anti wind-up control elements (not shown) to provide thermal limiting for a burner 12' implementing a sensor. The output 15 of the thermal limit controller 22 is input to a further power control unit for adjusting, e.g., quantizing the thermal limiter power output. This approach provides for very smooth power and temperature profiles but the temperature sensor is often expensive.

It would thus be highly desirable to provide a thermal limiting system and method for providing thermal limiting control to a cooktop burner of an electric cooking device, that provides for very smooth power without the use of an expensive thermal sensor.

SUMMARY OF THE INVENTION

A system and method for smoothly limiting the temperature of a burner of a cooking appliance, e.g. a stove ceramic burner, without the use of a temperature sensor. The method includes the steps of sensing the conduction state of a thermal switch in a bang-bang thermal limiting burner, and feeding back a signal representing this switch conduction state to control duty-cycle (and thus "on" time) of the applied power. The power to the burner is reduced until the sensed duty-cycle cycling is reduced (lower frequency and amplitude) resulting in smoother power and temperature control.

Preferably, this sensed duty-cycle cycling is increased to near 100%, i.e., the thermal switch conducting state is almost always on, i.e., off-time is reduced.

BRIEF DESCRIPTION OF THE DRAWINGS

Details of the invention disclosed herein shall be described below, with the aid of the figures listed below, in which:

FIG. 1(*b*) is a block diagram illustrating a typical thermal limiting architecture using temperature feedback control to provide thermal limiting;

DETAILED DESCRIPTION OF THE INVENTION

Figure 1A:
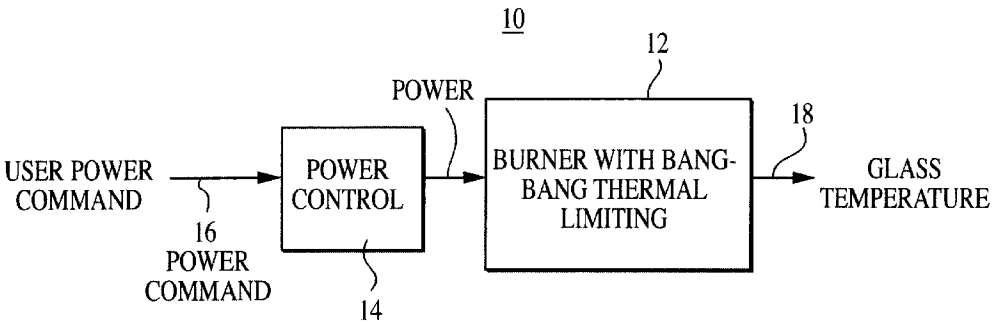
FIG. 1(a) PRIOR ART
FIG. 1(*a*) is a block diagram illustrating a typical thermal limiting architecture using bang-bang thermal limiting control.
Figure 1B:
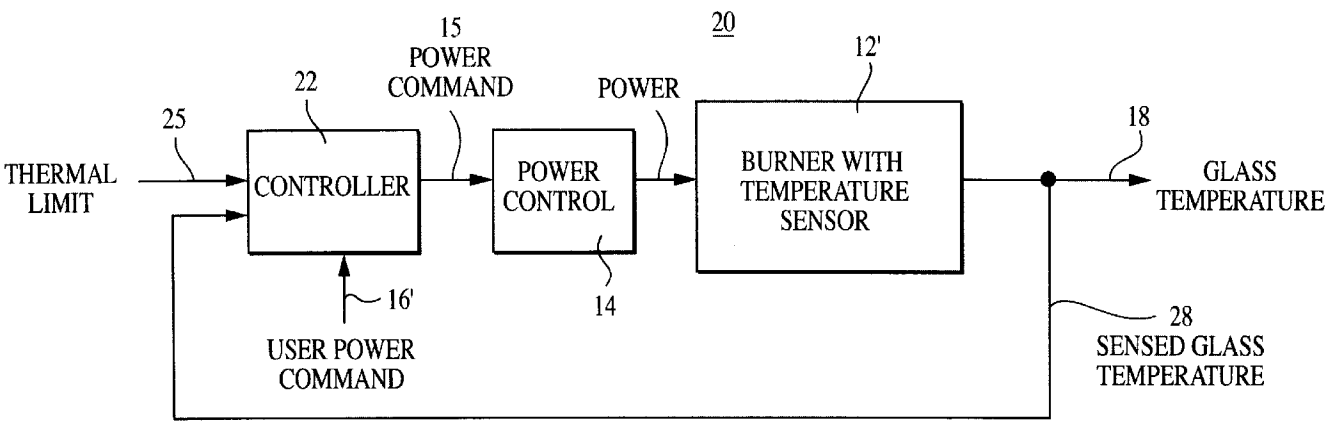
FIG. 1(b) PRIOR ART
Figure 2A:
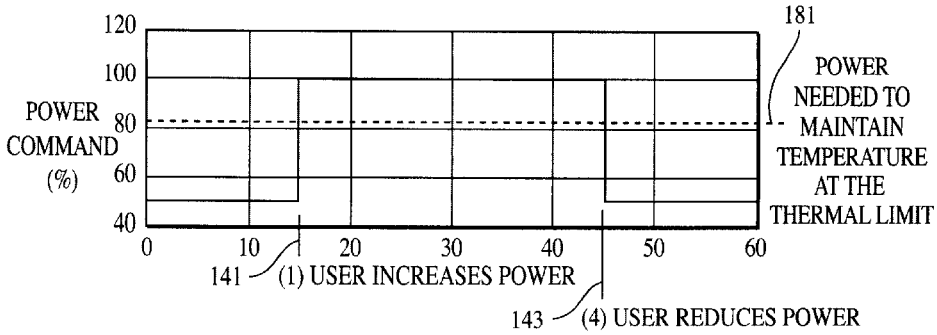
FIG. 2(a) PRIOR ART
FIGS. 2(*a*)–2(*c*) illustrate exemplary simulation results of a cooking appliance burner implementing bang-bang thermal limiting control.
Figure 2B:
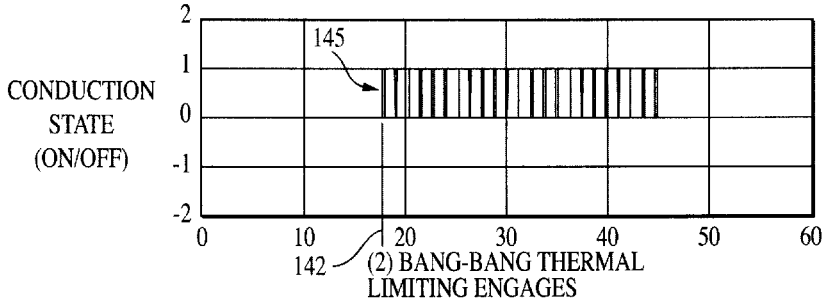
FIG. 2(b) PRIOR ART
Figure 2C:
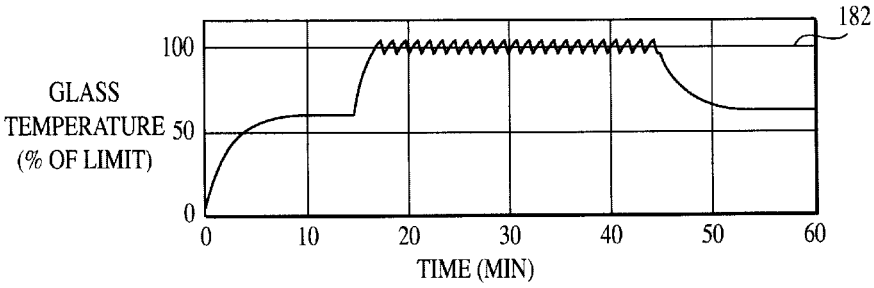
FIG. 2(c) PRIOR ART
Figure 3:
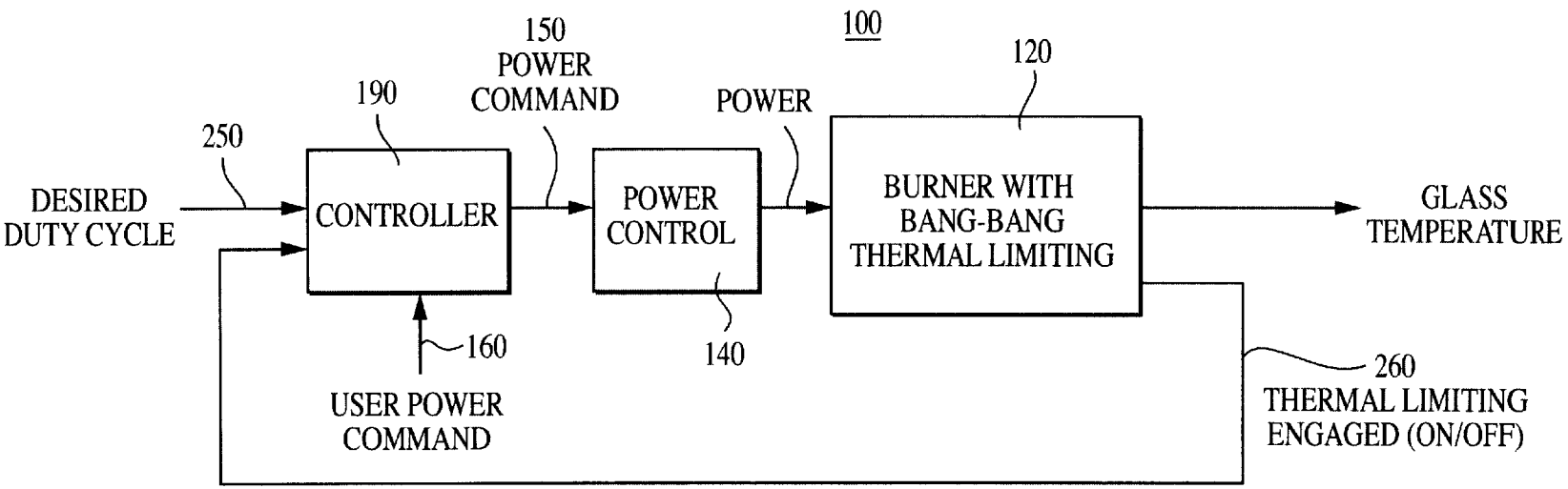
FIG. 3 is a high-level block diagram of the thermal limiting architecture of the present invention implementing bang-bang thermal limiting.

As now described with respect to FIG. 3, the present invention is a system and method 100 for reducing the power cycling by modifying the power applied to a ceramic burner 120, which uses bang-bang thermal limiting. The bang-bang controller works by interrupting power to the burner when the temperature exceeds a preset limit and restoring it again when it drops, usually with some hysteresis. Typically this is implemented with a thermal switch, e.g., a bimetallic switch (not shown).

As illustrated in FIG. 3, the conduction state of the switch represented as the "on/off" time signal output 260 representative of bang-bang thermal limiting, is fed back to a novel thermal limiting controller component 190, which also receives a desired user power command signal 160. The thermal limiting controller device 190 in response, outputs a minimum power value, that is, a power command signal generated either by the user from user manipulation of a burner control knob, for example, or the thermal controller. The power to the burner is reduced until the sensed duty-cycle is equal to a reference duty cycle 250 (that is, on the average). A power control element 140, typically an AC switch (e.g., a TRIAC), is actuated to receive the power command signal 150 output from the thermal limiting controller 200 and reduce the power via either cycle skipping, phase control, or the like, to provide power at fine resolutions for heating the burner. It is understood that one skilled in the art may implement other techniques for applying power in fine resolutions. A detailed description of a preferred mechanism for providing power control via cycle skipping is described in commonly-owned, co-pending U.S. patent application Ser. No. 10/000,275 entitled APPARATUS FOR CYCLE SKIPPING POWER CONTROL. Choosing a sufficiently large reference duty-cycle (near 100%) reduces thermal cycling (lower frequency and amplitude) and thus, provides smoother power and temperature control. Thus, if the user desires more power than the system can deliver, the invention will detect this power request, and the temperature controller will generate a power command signal 150 designed to limit the power the user asks for. According to the first embodiment, the temperature controller generates a signal causing application of power to the burner at a higher duty cycle (e.g., near 100% on time) either (at or below) the upper temperature safety limit. In this manner, the maximum power is being run without excessive bang-bang control engagement.

Figure 4:
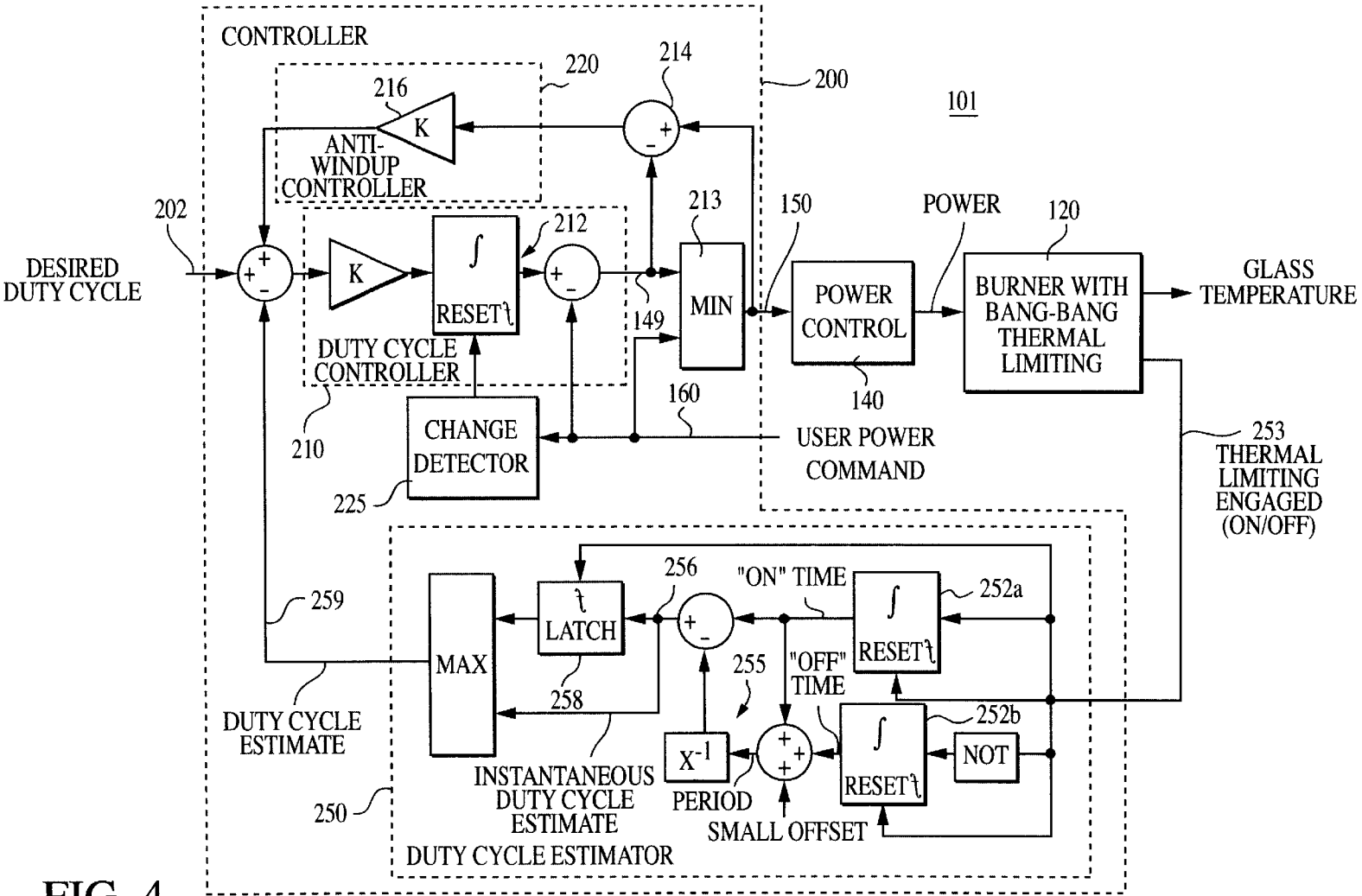
FIG. 4 is a detailed block diagram of the thermal limiting architecture of the present invention according to a first embodiment.

FIG. 4 illustrates one embodiment of the thermal limiting system and method of the invention depicted generally in FIG. 3. As shown in FIG. 4, the system 101 includes the following primary elements: the thermal limiter controller 200, including a duty cycle controller 210, anti-windup controller 220, and a duty cycle estimator 250. In this first embodiment, the thermal limiter controller 200 receives a signal 202 representing a desired duty cycle. For example, a signal 202 representing 100% duty cycle may comprise a pre-defined d.c. voltage while a signal 202 representing 50% duty cycle may be one-half of that pre-defined d.c. voltage level, etc. The duty cycle estimator 250 estimates the instantaneous duty-cycle by timing the "on" and "off" durations of the sensed conduction state, i.e., times when thermal limiting is engaged. Specifically, integrator circuits 252*a*, 252*b* receive a signal 253 representative of the on/off bang-bang control engagement cycle, i.e., conduction state of the thermal switch.

There are many: ways to obtain the conduction state of the thermal switch. For example: 1) by measuring the voltage across a small resistor in series with the burner load; 2) by measuring the voltage across the thermal switch; or, 3) by measuring the voltage across the TRIAC, etc. Care must be taken to measure the voltages when the AC switch in the power control 140 is conducting (unless some form of linear power regulation is employed rather than an AC switch is used for power control.

In the duty cycle estimator 250, respective integrator 252*a* integrates the signal to determine an "on" time proportional value, while the integrator 252*b* integrates the inverse of signal 253, i.e., representative of the "off" time, to determine an "off" time proportional value. Circuitry 255 adds the on time and off time proportional values to determine a total time. The circuit then computes the instantaneous bang-bang control duty cycle estimate 256 comprising the "on" time over the total time. At each cycle, i.e., each on/off transition resets the integrators 252*a*, 252*b* and resets a latch 258 which holds the duty cycle estimate of the prior cycle. The output signal 259 of the duty cycle estimator is the maximum of the instantaneous duty cycle estimate for the current cycle or the latched duty cycle estimate of the immediate prior cycle.

Thus, in the embodiment depicted in FIG. 4, the duty-cycle estimate is formed by averaging the thermal limiting conduction state. There is a heuristic modification as follows: 1) the instantaneous duty-cycle estimate is formed by the ratio of the cumulative "on" time to the cumulative total time (i.e. the instantaneous average) since the last thermal limiting cycle began (i.e. "on" to "off" transition); 2) at the end of the thermal limit cycle the instantaneous estimate is latched and held constant over the next interval as the previous cycle's estimate of duty-cycle; and, 3) the duty-cycle estimate is the maximum of the previously latched estimate and the current instantaneous estimate. This increases the responsiveness of the estimate when the duty-cycle is increasing.

Further, as shown in FIG. 4, the duty cycle estimate output signal 259 is input to the duty cycle controller 210 where it is compared to the desired duty cycle command signal 202 to provide a feedback signal which is input to an integral controller 212. The duty cycle controller 210 employs integral control 212 to regulate the duty-cycle to the desired value. The generated power command signal 150 is the minimum of the integrator output and the user specified power command 160. It is understood that the integrator 212 employed is reset when the user changes power.

As further shown in FIG. 4, an anti-windup controller 220 is employed to smooth transitions from the user power command to closed loop control, i.e., prevent the integrator 212 from winding up. The anti-windup controller circuit 220 comprises summer device 214 and amplifier device 216 for tracking the user power command. The summer device 214 receives the duty cycle controller thermal limiter input 149 and, the thermal limited power command signal 150 output of the minimum block 213 which comprises either one of the duty cycle controller thermal limiter input 149 to the minimum block 213 or, the user power command signal 160, and generates the difference. When the duty cycle controller thermal limiter input 149 is the minimum, this difference is zero the anti-wind up controller output is zero. However, the anti-wind up controller will track a difference signal when the user power command is in control. The difference signal is fed back to the duty cycle (integral) controller to form another control loop for tracking user power command and preventing integrator wind-up.

As further shown in FIG. 4, the controller circuit 200 further includes a change detector device 225 which resets when the user changes power. That is, the change detector device 225 takes the derivative of the user power. If the derivative is below some threshold, indicating user power reduction (when in the negative direction), the integrator is reset. It is understood that, a user power change in a positive direction may be also be detected to initiate further circuit correction.

Figure 5A:
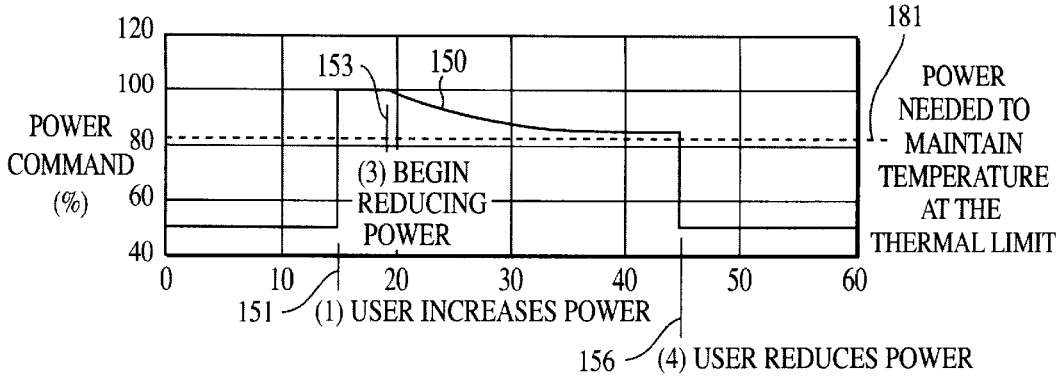
FIGS. 5(*a*)–5(*c*) illustrates an example simulation of bang-bang thermal control including power command, thermal switch conduction state and glass temperature implemented for a ceramic burner according to the first embodiment.
Figure 5B:
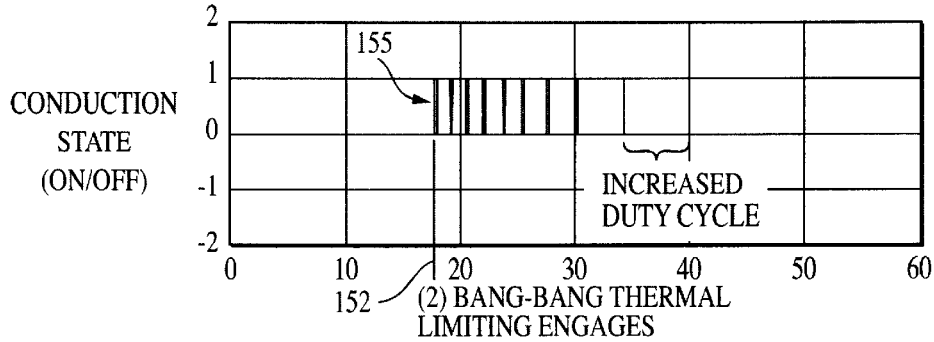
Figure 5C:
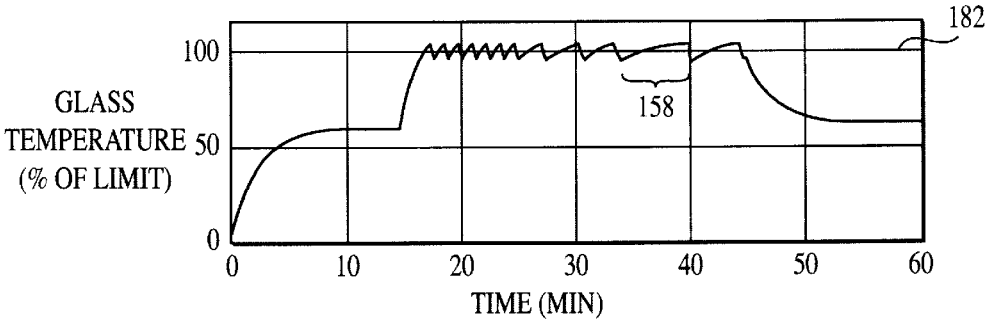

FIG. 5(*a*) illustrates an example simulation of bang-bang thermal control implemented for a ceramic burner according to the first embodiment of FIG. 4. In the example simulation, the thermal switch is modeled as a relay with an arbitrary 30° C. of hysteresis. The thermal response of the burner (e.g., glass temperature output) is modeled as a first order linear model (derived empirically). Initially, as shown in FIG. 5(*a*), the user-demanded power setting (user power command signal) is about one-half (50%)of the maximum power. At this initial setting, thermal limiting does not engage as indicated in FIG. 5(*b*). At the time indicated at 151, the user increases the power to 100% (FIG. 5(*a*)) causing the conduction state 155 of the thermal switch (e.g., bi-metallic switch) to change in accordance with bang-bang thermal limiting at time indicated as time 152 in FIG. 5(*b*) and thermal limiting is engaged. In FIG. 5(*b*), the conduction on/off states, i.e., engagement of bang-bang thermal limiting, according to the first embodiment of the invention, is represented as the plot 155. At the point in time indicated at time 153, the output power command signal 150 of the duty cycle controller becomes less than the user power command (the output of the minimum block of the duty cycle controller is generated from the duty cycle controller which is now in command to reduce the power to the burner). The power command 150 smoothly decreases to a value in close proximity above the power needed to maintain the temperature at the thermal limit, and the duty cycle of the bang-bang control,. i.e., "on" state of the thermal switch, increases according to the pre-set duty cycle signal 202, which is less than but approaching 100%. This preset value may be, e.g., 96%, or any appropriate value as long as the on time is significantly longer than the cycle off time and will vary depending upon the application. At this setting, the glass temperature of the burner increases to the thermal limit 182, e.g., the safety thermal limit of the burner, as shown in FIG. 5(*c*). As shown in FIG. 5(*c*), there are longer periods 158 of the thermal switch being in a conduction state. Finally, the user reduces the power back to its initial one-half power level and thermal limiting ceases, as indicated at time 156 in FIG. 5(*a*). In sum, as shown in FIG. 5(*b*), the duty cycle control of bang-bang thermal limiting for the example simulation according to the first embodiment demonstrates a slow response time due to the duty cycle estimation processing, but achieves a smooth power decrease as shown in FIG. 5(*a*).

It should be understood that the duty cycle estimator circuit 250 of FIG. 4, may be configured in a variety of ways known to skilled artisans. In a simple embodiment (not shown) the duty-cycle estimator may be simply replaced with a low pass filter having a time constant tau ($\tau$) greater than the typical "on" time (i.e., tau > typical on time) of the thermal limiting cycle to form the duty-cycle estimate 259. This may increase the controller response time, but the estimation circuit (duty cycle averaging) is simplified.

It should be further understood that in another embodiment (not shown) the duty-cycle estimation employed may be programmed in software operating under computer, e.g., microprocessor, control.

The same integral control described with respect to the first embodiment of FIG. 4, may be used without explicitly estimating duty-cycle of the conduction state. Thus, in a second embodiment of the invention, depicted in FIG. 6, a thermal limiting system and method 102 includes the following primary elements: the thermal limiter controller 300, including a duty cycle controller 310, and an anti-windup controller 320. In this second embodiment, the conduction state 353 of the thermal switch (not shown) is directly fed back to the controller 300 which, as in the first embodiment, performs a n averaging function. That is, the integrator 312 in the duty cycle controller circuit 310 intrinsically estimates the duty-cycle by averaging the conduction state signal 353 (the desired duty cycle minus the conduction state signal). Specifically, the integral control drives the difference between the desired duty cycle 302 and the average of the conduction state (i.e., estimate of the bang-bang engagement duty cycle) to zero. This control provides faster response (no explicit duty cycle estimator circuit) at the expense of saw-tooth like power cycling, which may be beneficial in some applications.

Figure 6:
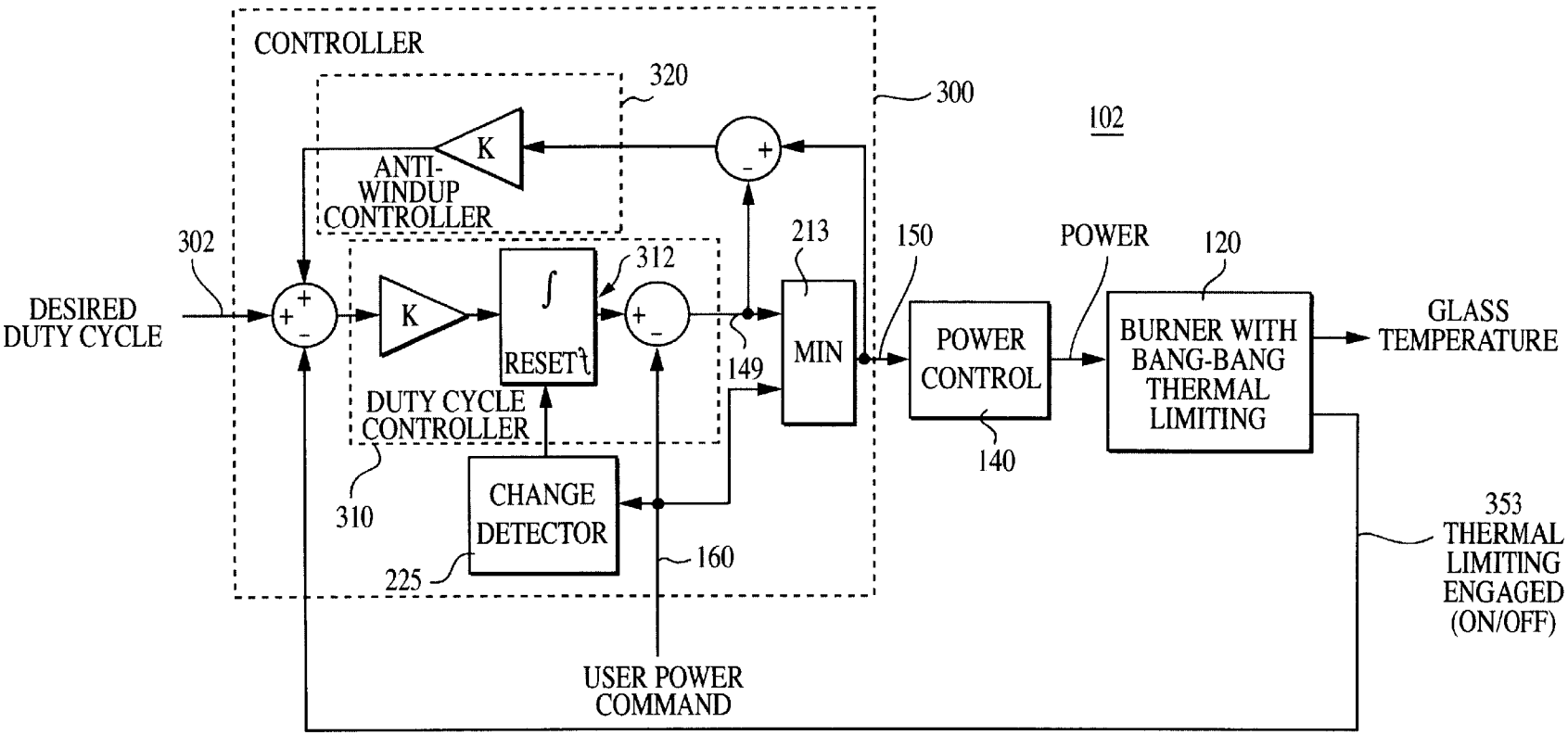
FIG. 6 is a detailed block diagram of the thermal limiting architecture of the present invention according to a second embodiment.
Figure 7A:
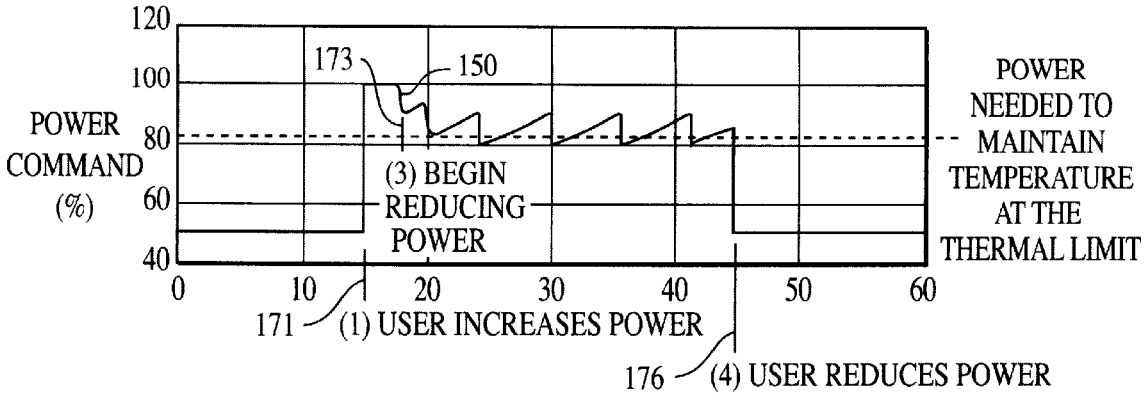
FIGS. 7(*a*)–7(*c*) illustrates an example simulation of bang-bang thermal control including power command, thermal switch conduction state and glass temperature implemented for a ceramic burner according to the second embodiment.
Figure 7B:
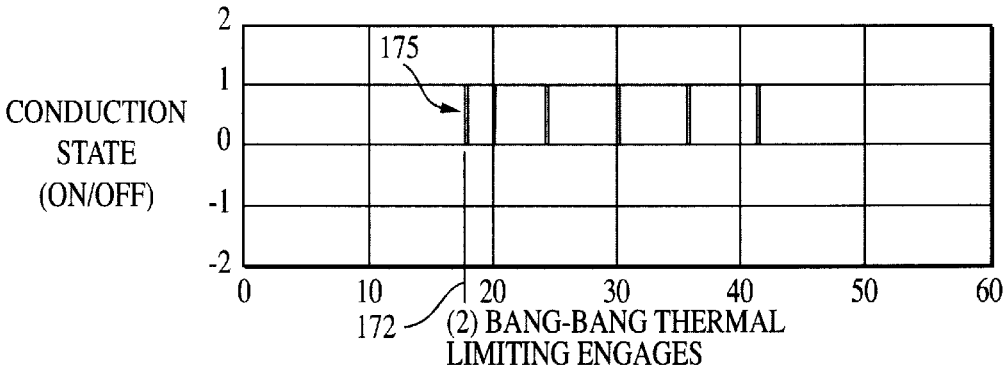
Figure 7C:
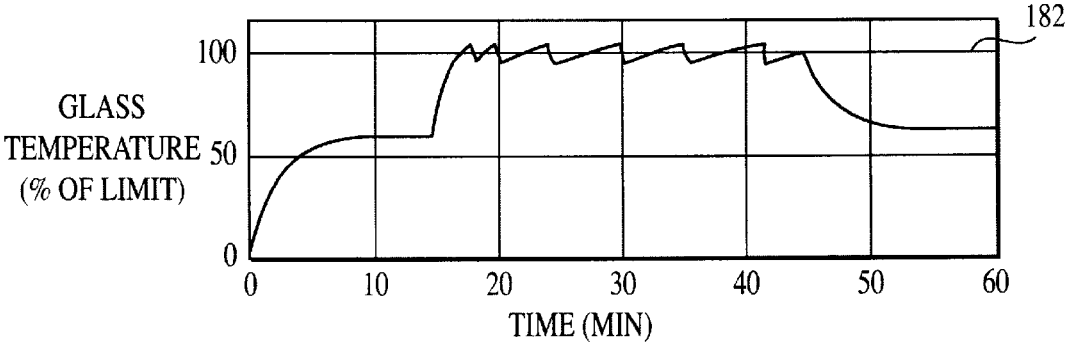

FIG. 7(*a*) illustrates an example simulation of bang-bang thermal control implemented for a ceramic burner according to the second embodiment of FIG. 6. In the example simulation, the user-demanded power setting (user power command signal) is about one-half (50%) of the maximum power. At this initial setting, thermal limiting does not engage as indicated in FIG. 7(*b*). At the time indicated at 171, the user increases the power to 100% (FIG. 7(*a*)) causing the conduction state 175 of the burner's thermal switch (e.g., bi-metallic switch) to change in accordance with bang-bang thermal limiting at time indicated as time 172 in FIG. 7(*b*) and thermal limiting is engaged. In FIG. 7(*b*), the conduction on/off states, i.e., engagement of bang-bang thermal limiting, according to the second embodiment of the invention, is represented as the plot 175. At the point in time indicated at time 173, the duty cycle controller 300 is activated for limiting output power, and the power command signal 150 starts decreasing (becomes less than the user power command). As shown in FIG. 7(*b*), as bang-bang control is engaged, the power command signal: 150 again increases when the conduction state is on and decreases when the conduction state is off in a saw-tooth fashion according to the conduction state. This is because the input to the integral controller 312 is only one of two values: the desired duty cycle 202 minus zero, i.e., when the conduction state is zero (0), or the desired duty cycle 202 minus one, i.e., when the conduction state is one (1), as the conduction state is directly fed back to the controller. This power command thus will always have two different values increasing or decreasing at two different slopes (never zero). Thus, as the integrator integrates up or down, the power command 150 oscillates to maintain burner temperature at or about the thermal limit. This results in the glass temperature oscillating about the thermal limit temperature 182, i.e., the safety thermal limit of the burner, as shown in FIG. 7(*c*). Finally, the user reduces the power back to its initial one-half power level and thermal limiting ceases, as indicated at time 176 in FIG. 7(*a*). As shown in FIG. 7(*b*), the duty cycle control of bang-bang thermal limiting of the example simulation according to the second embodiment responds more quickly than the controller circuit of the first embodiment of 5(*b*), however at the expense of greater power fluctuation as shown in FIG. 7(*a*).

Figure 8:
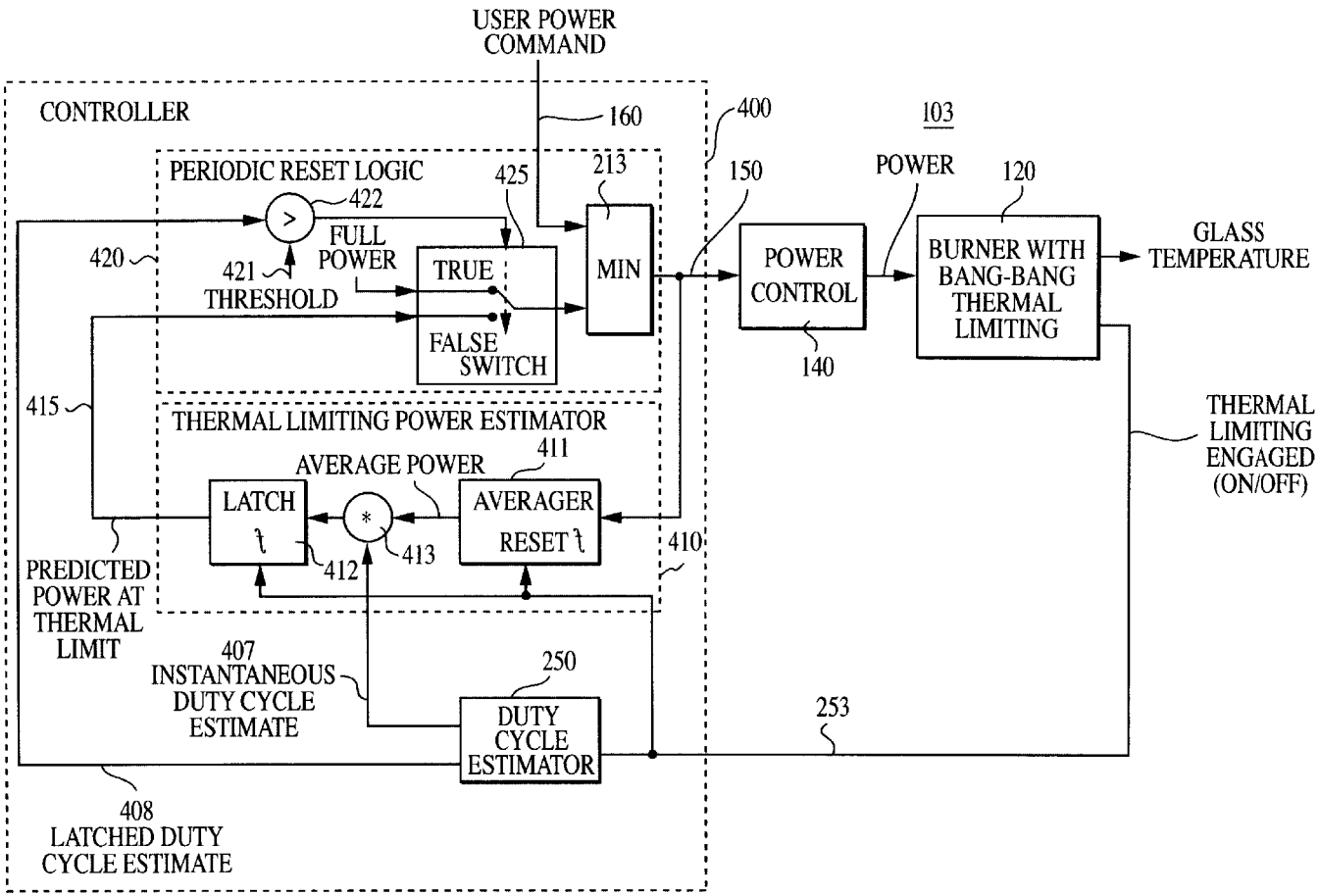
FIG. 8 is a detailed block diagram of the thermal limiting architecture of the present invention according to a third embodiment; and, FIGS. 9(*a*)–9(*c*) illustrates an example simulation of bang-bang thermal control including power command, thermal switch conduction state and glass temperature implemented for a ceramic burner according to the third embodiment.

In a third embodiment of the invention, depicted in FIG. 8, a thermal limiting system and method 103 is provided for directly calculating power needed to maintain the temperature at the thermal limit, or else apply the user power, whichever is smaller. Thus, in the third embodiment of the invention, depicted in FIG. 8, the power command controller element 400 includes: a duty cycle estimator circuit which may be the estimator circuit 250 according to the first embodiment, a low pass filter, or like software or hardware implemented duty cycle averaging device; a thermal limiting power estimator device 410 including a multiplier device 413 and an averaging circuit 411 for averaging how much power it estimates is being applied to the burner based on the product of the estimated instantaneous duty cycle 407 and the average of the power command signal 150 being requested; and., a periodic reset logic circuit 420 for periodically calculating and applying the power needed to maintain temperature at the thermal limit. That is, by itself this method would cycle only once and consequently stop responding to changing thermal conditions (e.g. pan removal, contents added to pan, etc.). Periodic re-computation is necessary and is achieved by resetting power to the user power command whenever the estimated duty-cycle is greater than a predetermined threshold 421 as performed by comparator circuit 422. The value of the threshold 421 sets the period of the re-computation and functions similar to the desired duty cycle in the first and second embodiments. Thus, if the current latched duty cycle estimate signal 408 output from the duty cycle estimator 250 is greater than the duty cycle threshold value, e.g., typically a fixed value between 90% to 99.9% dependent upon a specific application, and for exemplary purposes is 0.96, then the lesser of the full power value or user power command value 160 (at the minimum block 213) will be applied to maintain the burner at the thermal limit as indicated by a switch 425. Otherwise, the predicted power 415 at the thermal limit will be applied. Preferably, the predicted thermal limiting power 415 is the product of the duty-cycle and the average power over the last cycle and which has been held constant (latched) by latch device 412 over the current cycle. The output 415 of the thermal limiting power estimator device 410 is the predicted power at the thermal limit and is input to the switch device 425 provided in the periodic reset logic circuit 420. The switch device 425 outputs either full power, or, the predicted power 415 at the thermal limit output from the estimator that is the power required to maintain the burner at the thermal safety limit. The reset logic interacts to periodically compute the estimate of the power required to just maintain the temperature at the thermal limit 415.

Figure 9A:
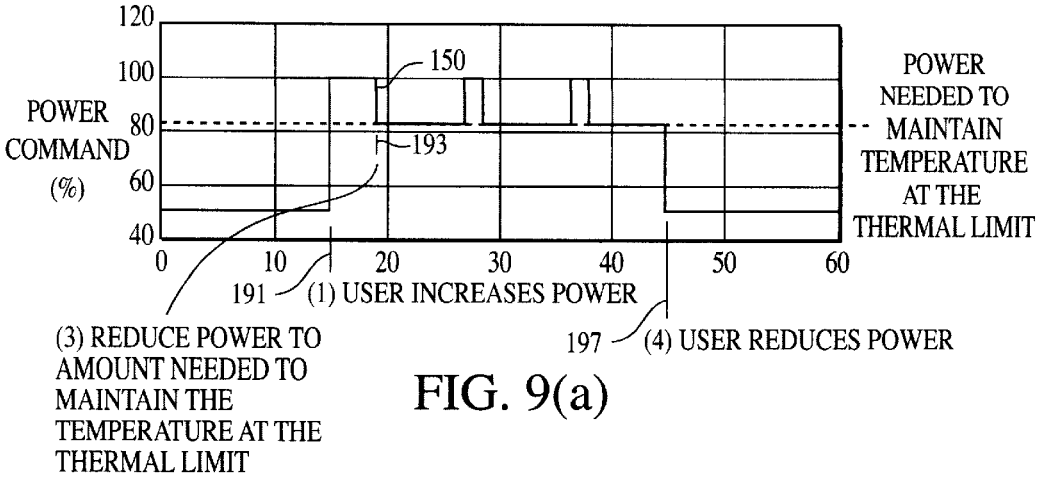
Figure 9B:
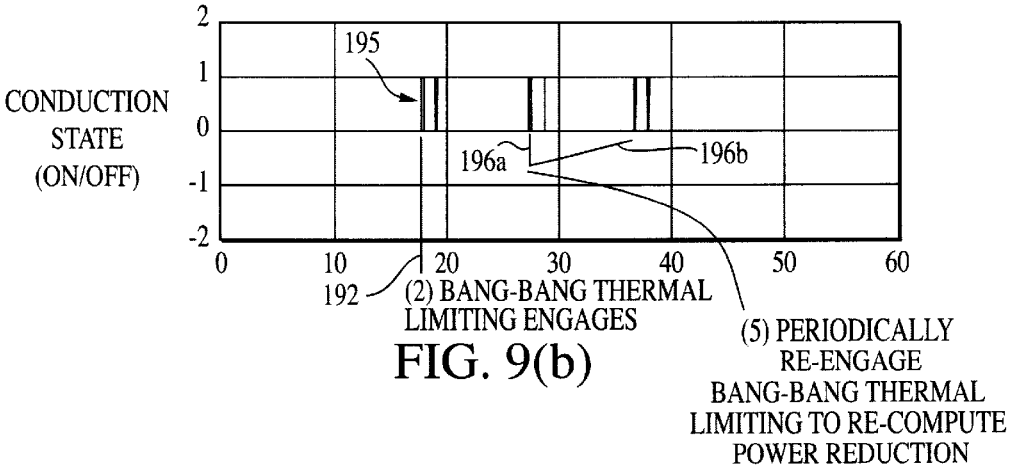
Figure 9C:
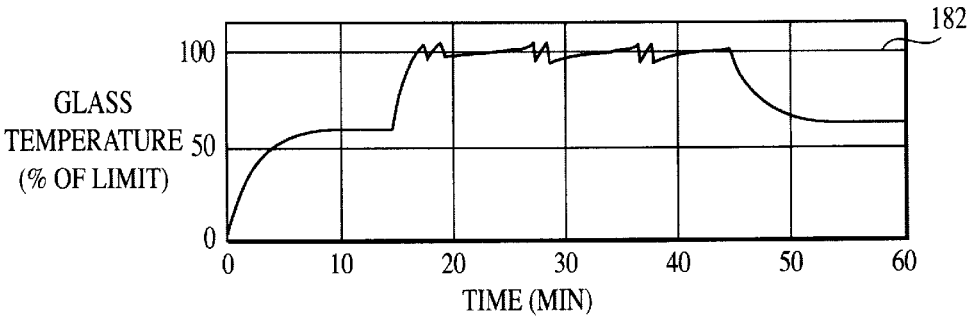

FIG. 9(*a*) illustrates an example simulation of bang-bang thermal control implemented for a ceramic burner according to the third embodiment of FIG. 8. In the example simulation, the user-demanded power setting (user power command signal) is about one-half (50%) of the maximum power. At this initial setting, thermal limiting does not engage as indicated in FIG. 9(*b*). At the time indicated at 191, the user increases the power to 100% (FIG. 9(*a*)) causing the conduction state 195 of the burner's thermal switch (e.g., bi-metallic switch) to change in accordance with bang-bang thermal limiting at time indicated as time 192 in FIG. 9(*b*) and thermal limiting is engaged. According to this embodiment, at least one cycle of bang-bang control is needed to estimate what the average power was over that cycle. In FIG. 9(*b*), the conduction on/off states, i.e., engagement of bang-bang thermal limiting, according to the third embodiment of the invention, is represented as the plot 195. At the point in time indicated at time 193, after the one cycle duration in which the power estimate has been made, the power command is decreased to that estimated power value. That is, returning to FIG. 8, in the power command controller element 400, the predicted power level 415 is computed for the first time, and thus the output of minimum block 213 changes to reduce output power from the user power command 160, to the predicted power 415 required to maintain temperature at the thermal limit. As shown in FIG. 9(*b*), bang-bang control thermal limit cycles are periodically re-engaged, for example, at steps 196*a* and 196*b*, etc. At each of these periodic intervals, the controller element 400 switches the power back to what the user has requested, and after the bang-bang thermal control limit cycle, the power command is re-set to the predicted power level (i.e., average power that was applied) to maintain burner temperature at or about the thermal limit. This results in the glass temperature varying about the thermal limit temperature 182, i.e., the safety thermal limit of the burner, as shown in FIG. 9(*c*). Finally, the user reduces the power back to its initial one-half power level and thermal limiting ceases, as indicated at time 197 in FIG. 9(*a*). As shown in FIG. 9(*b*), the duty cycle control of bang-bang thermal limiting of the example simulation according to the third embodiment responds more quickly than the controller circuit of the first embodiment of 5(*b*), however at the expense of greater power fluctuation as shown in FIG. 9(*a*).

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

Having thus described my invention, what we claim as new, and desire to secure by Letters Patent is:

1. A thermal limiter control system for a heating element provided in a cooking appliance, said appliance implementing bang-bang thermal limiting control whereby a conduction state of a thermal switch device is engaged to either interrupt or enable application of power to said heating element according to a temperature of said heating element, the thermal limiter control system comprising:

a means for sensing said conduction state of said thermal switch device when engaged during a thermal limiting cycle; and a feedback control means utilizing said sensed conduction state to control a duty cycle of said bang-bang thermal limiting control during said thermal limiting cycle, said feedback control means further actuating power amount applied to said heating element during said thermal limiting cycle.

2. The thermal limiter control system according to claim 1, wherein said feedback control means comprises:

a thermal limit controller device for directly receiving a signal representing said sensed conduction state of said thermal switch when implementing bang-bang thermal limiting control and, a signal representing a desired duty cycle for bang-bang thermal limiting control, and generating a thermal limiting power command signal based on a difference between said sensed conduction state and said desired duty cycle signals.

3. The thermal limiter control system according to claim 2, wherein said thermal limit controller device includes a proportional plus integral controller circuit for generating said thermal limiting power command signal based on said difference between said sensed conduction state and said desired duty cycle signals.

4. The thermal limiter control system according to claim 3, further comprising:

a power control device responsive to said thermal limiting power command signal for applying power to said heating element for maintaining a temperature of said heating element at about a thermal limit by enabling thermal switch conduction state switching at said desired duty cycle having an increased an on-time.

5. The thermal limiter control system according to claim 3, wherein said thermal limit controller device further comprises:

means for estimating a duty cycle of said sensed conduction state and generating a signal representing said duty cycle estimate, said thermal limit controller device generating said thermal limiting power command signal based on a difference between said duty cycle estimate and said desired duty cycle signals.

6. The thermal limiter control system according to claim 5, wherein said means for estimating a duty cycle of bang-bang thermal limiting control comprises:

a device for forming an instantaneous duty cycle estimate representing a ratio of a cumulative "on" time to a cumulative total time since an immediately prior bang-bang thermal limiting cycle; and, a latching device for latching said instantaneous duty cycle estimate at an end of a thermal limiting cycle;

wherein said current instantaneous duty cycle estimate is a maximum of a previously latched estimate held constant from said immediately prior thermal limiting cycle:and said current instantaneous duty cycle estimate.

7. The thermal limiter control system according to claim 5, wherein said duty cycle estimate control device comprises a low pass filter device for receiving said sensed conduction state, said low pass filter device having a time constant greater than said on-time of said thermal switch conduction state.

8. The thermal limiter control system according to claim 5, further comprising a device for enabling input of a desired user temperature setting for said heating element, and generating a user power command signal representative of said desired user temperature setting; and, a minimum selector device for selecting a minimum of either said user power command signal or, said thermal limiting power command signal for controlling application of power to said heating element.

9. The thermal limiter control system according to claim 8, further comprising:

an anti-wind up controller connected to said thermal limiter controller for tracking a thermal limit power level represented by said thermal limiting power command signal to a user power level represented by said user power command signal and, applying a difference between said thermal limit power level and user power level to said proportional plus integral controller circuit, said proportional plus integral controller circuit preventing wind up of an integrator in said proportional plus integral controller circuit.

10. The thermal limiter control system according to claim 8, further comprising a change detector device for detecting a change of said input user power command signal and resetting an integrator in said proportional plus integral controller circuit in response to a detected change.

11. The thermal limiter control system according to claim 1, wherein said feedback control means comprises:

a means for estimating a duty cycle of said sensed conduction state and generating a signal representing said duty cycle estimate; and, a means responsive to said duty cycle estimate signal and a currently generated thermal limiting power command signal for predicting a power level needed to maintain temperature of said heating element at about said thermal limit and generating a predicted power level signal; and, a periodic reset logic circuit for periodically calculating and applying said predicted power level signal needed to maintain temperature at the thermal limit.

12. The thermal limiter control system according to claim 11, wherein said predicting means includes:

an averaging circuit for generating an average of how much power is being applied to the heating element based on said thermal limiting power command signal; and, a multiplier device for multiplying said average power with said estimated duty cycle signal to provide said predicted power level.

13. The thermal limiter control system according to claim 12, wherein said periodic reset logic circuit includes:

a means for comparing said estimated duty cycle against a predetermined threshold and generating a thermal limiting power command signal comprising one of:

a full power level for initiating bang-bang thermal control or, said predicted power level at said thermal limit, wherein said bang-bang thermal control is periodically initiated.

14. The thermal limiter control system according to claim 1, wherein said heating element is provided in a burner of a glass-ceramic cooktop appliance.

15. A method for controlling an amount of power being applied to a heating element provided in a cooking appliance, said appliance implementing bang-bang thermal limiting control whereby a conduction state of a thermal switch device is engaged to either interrupt or enable application of power to said heating element according to a temperature of said heating element during a thermal limiting cycle, the thermal limiter control method comprising the steps of:

a) sensing said conduction state of said thermal switch device when engaged during a thermal limiting cycle; and b) utilizing said sensed conduction state to control a duty cycle of said bang-bang thermal limiting control during said thermal limiting cycle, and, actuate power to said heating element during said thermal limiting cycle.

16. The method according to claim 15, further including the steps of:

directly receiving a signal representing said sensed conduction state of said thermal switch when implementing bang-bang thermal limiting control;

receiving a signal representing a desired duty cycle for bang-bang thermal limiting control; and, generating a thermal limiting power command signal based on a difference between said sensed conduction state and said desired duty cycle signals.

17. The method according to claim 16, further comprising the step of:

providing proportional plus integral control circuit for generating said thermal limiting power command signal based on said difference between said sensed conduction state and said desired duty cycle signals.

18. The method according to claim 17, further comprising the steps of:

applying power to said heating element in response to said thermal limiting power command signal, said power for maintaining a temperature of said heating element at about a thermal limit by enabling thermal switch conduction state switching at said desired duty cycle having an increased on-time.

19. The method according to claim 17, wherein said sensing step a) comprises the steps of:

c) estimating a duty cycle of said sensed conduction state and generating a signal representing said duty cycle estimate, wherein said utilizing step b) comprises:

generating said thermal limiting power command signal based on a difference between said duty cycle estimate and said desired duty cycle signals.

20. The method according to claim 19, wherein said step c) of estimating a duty cycle of bang-bang thermal limiting control comprises the steps of:

forming an instantaneous duty cycle estimate representing a ratio of a cumulative "on" time to a cumulative total time since an immediately prior bang-bang thermal limiting cycle; and, latching said instantaneous duty cycle estimate at an end of a thermal limiting cycle, wherein said current instantaneous duty cycle estimate is a maximum of a previously latched estimate held constant from said immediately prior thermal limiting cycle and said current instantaneous duty cycle estimate.

21. The method according to claim 19, wherein said step of estimating a duty cycle of bang-bang thermal limiting control comprises the step of providing a low pass filter for receiving said sensed conduction state, said low pass filter having a time constant greater than said on-time of said thermal switch conduction state.

22. The method according to claim 19, further comprising the steps of:

enabling input of a desired user temperature setting for said heating element, and generating a user power command signal representative of said desired user temperature setting; and, selecting a minimum of either said user power command signal or, said thermal limiting power command signal for controlling application of power to said heating element.

23. The method according to claim 22, further comprising the step of preventing wind up of an integrator in said proportional plus integral control circuit by:

tracking a thermal limit power level represented by said thermal limiting power command signal to a user power level represented by said user power command signal; and, applying a difference between said thermal limit power level and user power level to said proportional plus integral control circuit.

24. The method according to claim 22, further comprising the step of:

detecting a change of said input user power command signal; and resetting an integrator in said proportional plus integral control circuit in response to a detected change.

25. The method according to claim 15, wherein said sensing step a) comprises the step of:

c) estimating a duty cycle of said sensed conduction state and generating a signal representing said duty cycle estimate; said utilizing step b) comprising:

d) predicting a power level needed for maintaining temperature of said heating element at about said thermal limit and generating a predicted power level signal; and, e) periodically calculating and applying said predicted power level signal needed to maintain temperature at the thermal limit.

26. The method according to claim 25, wherein said predicting step includes:

generating an average of how much power is being applied to the heating element based on said thermal limiting power command signal; and, multiplying said average power with said estimated duty cycle to provide said predicted power level.

27. The method according to claim 26, wherein said periodically calculating and applying step comprises the step of:

comparing said estimated duty cycle against a predetermined threshold and, generating a thermal limiting power command signal comprising one of: a full power level for initiating bang-bang thermal control or, said predicted power level at said thermal limit, wherein said bang-bang thermal control is periodically initiated.

28. A thermal limiter control system for a heating element provided in a heating appliance, said appliance implementing bang-bang thermal limiting control whereby a conduction state of said thermal switch device is engaged to either interrupt or enable application of power to said heating element according to a temperature of said heating element during a thermal limiting cycle, the thermal limiter control system comprising:

means for sensing said thermal switch conduction state and estimating a duty cycle of said conduction state during said thermal limiting cycle;

thermal limiter control device for receiving said duty cycle estimate and a reference duty cycle representing a thermal limit for said heating device, and generating a thermal limiting power level based on a difference between said duty cycle estimate and a reference duty cycle; and, means responsive to said thermal limiting power level for reducing power applied to the heating element during said thermal limiting cycle while increasing a duty cycle of said thermal switch conduction state according to reference duty cycle, wherein a temperature of said heating element is at or about said thermal limit during said thermal limiting cycle.

* * * * *